United States Patent [19]

Johnson

[11] Patent Number: 4,599,965

[45] Date of Patent: Jul. 15, 1986

[54] PIVOTALLY MOUNTED DIVER'S SIGNAL FLAG

[76] Inventor: Robert E. Johnson, 5175 Lehrer Dr., San Diego, Calif. 92117

[21] Appl. No.: 679,645

[22] Filed: Dec. 10, 1984

[51] Int. Cl.[4] ..... G09F 17/00

[52] U.S. Cl. ..... 116/209; 116/173; 116/215

[58] Field of Search ..... 33/391; 40/586, 590, 40/591, 598, 601, 602, 608; 116/26, 173–175, 209, 216, 303, 28 R, 210, 215; 405/185, 186; 441/80, 89, 108

[56] References Cited

U.S. PATENT DOCUMENTS

| | | | |
|---|---|---|---|
| 1,102,413 | 7/1914 | Jensen | 116/173 |
| 3,104,644 | 9/1963 | Burton | 116/173 |
| 3,169,739 | 2/1965 | Yacobian | 116/173 |
| 3,872,529 | 3/1975 | Wainwright | 116/173 |
| 3,958,752 | 5/1976 | Pieszchala | 116/215 |
| 4,035,856 | 7/1977 | Oberg | 116/173 |

FOREIGN PATENT DOCUMENTS

| | | | |
|---|---|---|---|
| 495090 | 7/1954 | Italy | 116/28 |
| 563050 | 6/1975 | Switzerland | 40/586 |

*Primary Examiner*—Charles Frankfort
*Assistant Examiner*—W. Morris Worth
*Attorney, Agent, or Firm*—Baker, Maxham & Jester

[57] ABSTRACT

A diver's signal flag which is pivotally attached to the diver's belt or other portion of his equipment and protrudes above the water when the diver is at or just below the surface to indicate the presence of the diver to passing boats, other divers or rescue crews. The pivotal mounting allows the flag supporting mast to deflect when passing under kelp or similar obstructions. In a preferred form of the apparatus the flag mast is balanced by a pendulum weight to remain vertical and projects above the water regardless of the attitude of the diver. When submerged the flag remains erect and provides the diver with high visibility to other divers.

10 Claims, 12 Drawing Figures

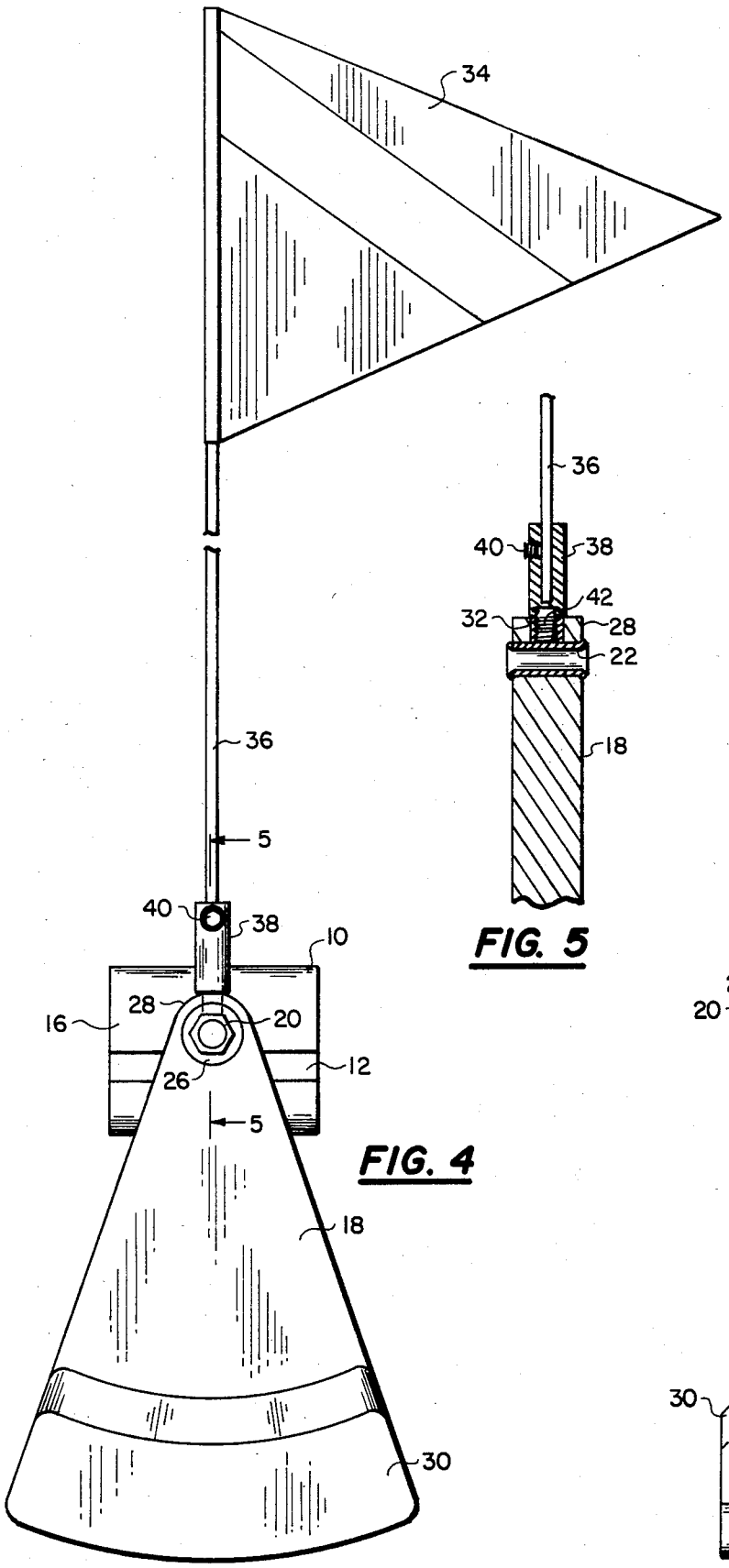
FIG. 4
FIG. 5
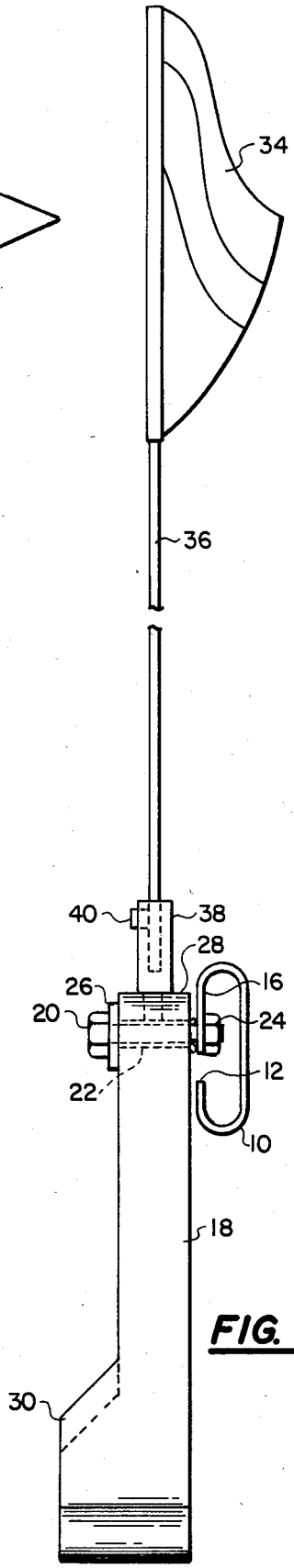
FIG. 6

PIVOTALLY MOUNTED DIVER'S SIGNAL FLAG

BACKGROUND OF THE INVENTION

When a diver is operating in the water, particularly near the surface, it is customary to have a marker such as a buoy or flag to indicate the presence of a diver to passing boats. A diver at or just below the surface is not easily visible and can be injured by a boat or its propeller, so marking is important. Some divers have tethered floats of flags but these markers are usually some distance away. A flag is mounted on a mast which projects above the surface when the diver is in a near horizontal position, face down for underwater observation. However, in some positions the flag is pulled under the surface unless constant adjustments are made. Also a fixed flag can become entangled in kelp or other obstructions and hinder or even trap a diver.

It is desirable to have a prominent marker which will project above the surface in any position of the diver and which will be easily deflected by obstacles without entangling the diver.

SUMMARY OF THE INVENTION

The signal flag can be mounted on the diver's belt, or any convenient portion of the harness or air tank assembly. With the pendulum weighted flag the most convenient position is on the weight belt at one side of the diver. A simple retaining clip permits easy attachment or removal.

A standard signal flag is carried on a mast of suitable length to extend sufficiently above the diver, the mast being plugged into a socket member on the mounting fixture, which is preferably a pendulum element pivotally mounted on a bracket or clip for attachment to the diver.

In another form the mounting is resilient to allow the mast to be deflected by obstacles and to return to the erect position.

At all times the flag is extended from the diver for maximum visibility at any position of the diver, either on or near the surface or when submerged. The flag is particularly visible in choppy water where a conventional surface float might be difficult to see. Under water the flag will indicate the presence of a diver behind rocks or marine growth and, due to waving motion caused by movement of the diver, will make a diver more easily visible at a distance.

The object of this invention, therefore, is to provide a device for reducing the hazard associated with diving.

Another object is to provide a device for attracting attention to the presence of a diver.

Still another object is to provide a diver carried device that projects above the water to warn of the diver's presence.

Yet another object is to provide a diver safety device that vertically extends above the water's surface.

Yet another object is to provide a diver safety device that vertically mounts a flag on a mast irrespective of a diver's attitude.

A further object is to provide a pivotally mounted mast carrying a flag that indicates the presence of a diver at or near the surface.

Another object is to provide a diver safety device fabricated to allow free passage through aquatic plants such as kelp.

Still a further object is to provide a pivotally mounted pendulum weighted mast and flag that keeps a vertical orientation and requires little or no diver attention.

Another object is to provide a resiliently mounted shaft and flag fabricated from material flexible enough to permit free passage through aquatic plants yet having sufficient stiffness to stand vertically to warn of the presence of a diver.

Other objects and advantages will be found in the following detailed description and accompanying drawings.

BRIEF DESCRIPTION OF THE DRAWINGS

FIG. 4 is an enlarged side elevation view of the complete flag unit;

FIG. 5 is a sectional view taken on line 5—5 of FIG. 4;

FIG. 6 is a view taken from the right hand side of FIG. 4;

DESCRIPTION OF THE PREFERRED EMBODIMENTS

Figure 1:
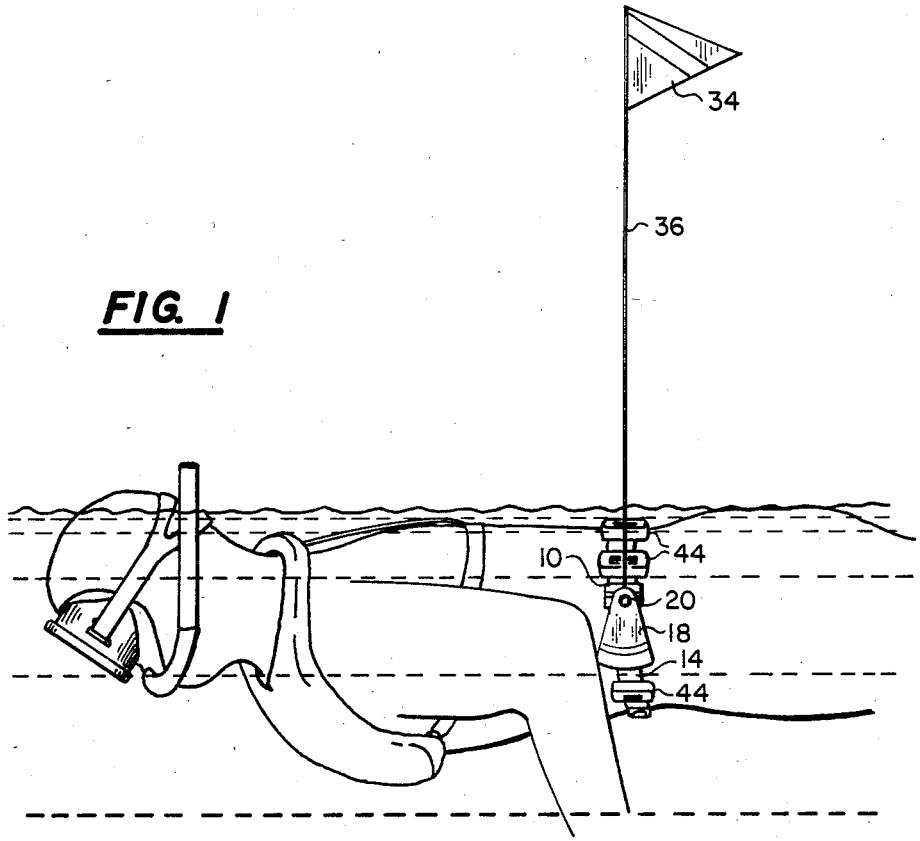
FIG. 1. is a side elevation view of a pendulum mounted flag attached to a diver's weight belt.

The configuration illustrated in FIGS. 1–6 is mounted on a diver's weight belt or other body encircling belt portion of the equipment. As shown, a generally C-shaped clip 10 has a narrow opening 12 through which the belt 14 can be inserted, the clip substantially encircling the belt. This has been found to be quite secure, but more positive fastening means can be used if desired.

The clip 10 has a flat mounting plate 16 to which a pendulum 18 is pivotally attached by means of a pivot pin 20. The pivot pin is shown as a bolt which passes through a bushing 22 in the top portion of the pendulum and is secured by a nut 24, preferably of the self-locking type, behind the mounting plate 16, as in FIG. 5. A washer 26 may be used under the bolt head to prevent binding.

The pendulum 18 is a triangular or pie segment shaped member pivoted at the upper apex 28, the wide lower portion 30 being thickened to provide the pendulum mass. Fixed in the apex 28 and extending above the pivot is a threaded sleeve 32 for attachment of the flag.

The flag 34 is the standard type flag used to identify a diver and is of triangular shape with a white diagonal stripe on a red background. Mast 36 is a long thin element of metal rod or fiber reinforced plastic, to which the flag is secured in any suitable manner. If a metal rod is used it may be coated with plastic or otherwise suitably finished, preferably in white or another high visibility color.

The mast 36 fits into a cylindrical socket member 38 and may be secured by a set screw 40, or have a snap or friction type lock. The lower end of socket member 38 has a threaded stud 42 which is screwed into threaded sleeve 32 in the pendulum. The mast and flag are thus easily removable when necessary but stay securely in place during use.

It has been found that, when the weights 44 on belt 14 are adjusted to provide clearance, the pendulum 18 will swing freely and hold or bias the mast 36 in vertical position. In FIG. 1 the diver is in a generally horizontal position near the surface and the flag is held well above the water. It can be readily seen above choppy water where the usual surface float would be concealed. In the vertical position of the diver, as in FIG. 2, the flag is above the diver's head and provides added visibility due to its color and movement.

The flag is equally effective below water since the flag and the high visibility mast will still remain erect due to the pendulum action. At the bottom the flag would show the presence of a diver who could otherwise be concealed behind rocks, thus avoiding possible injury from other divers.

Figure 2:
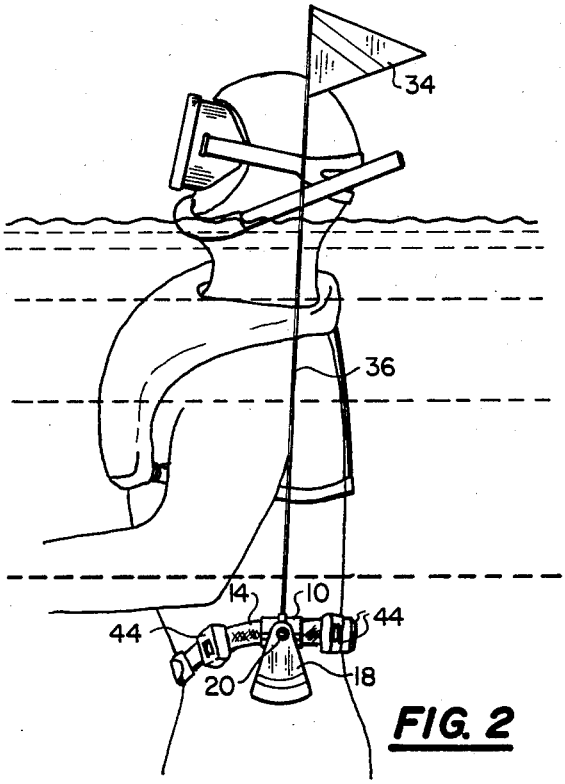
FIG. 2 is a similar view with the diver in an upright position.
Figure 3:
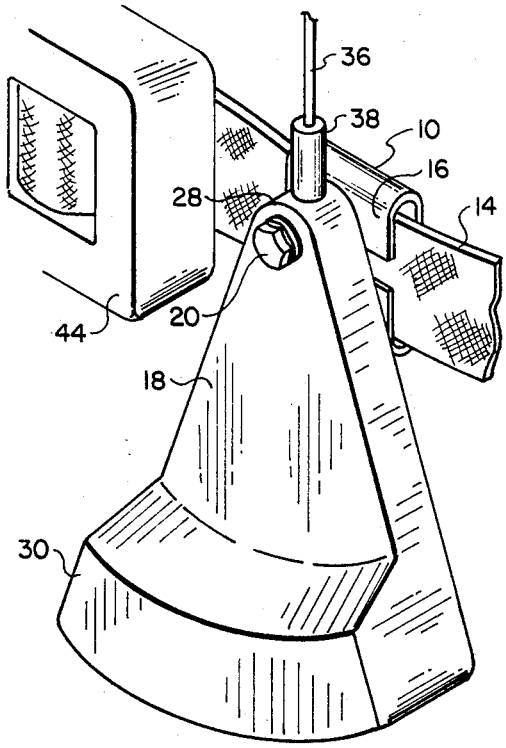
FIG. 3 is an enlarged perspective view of the pendulum mounting.
Figure 7:
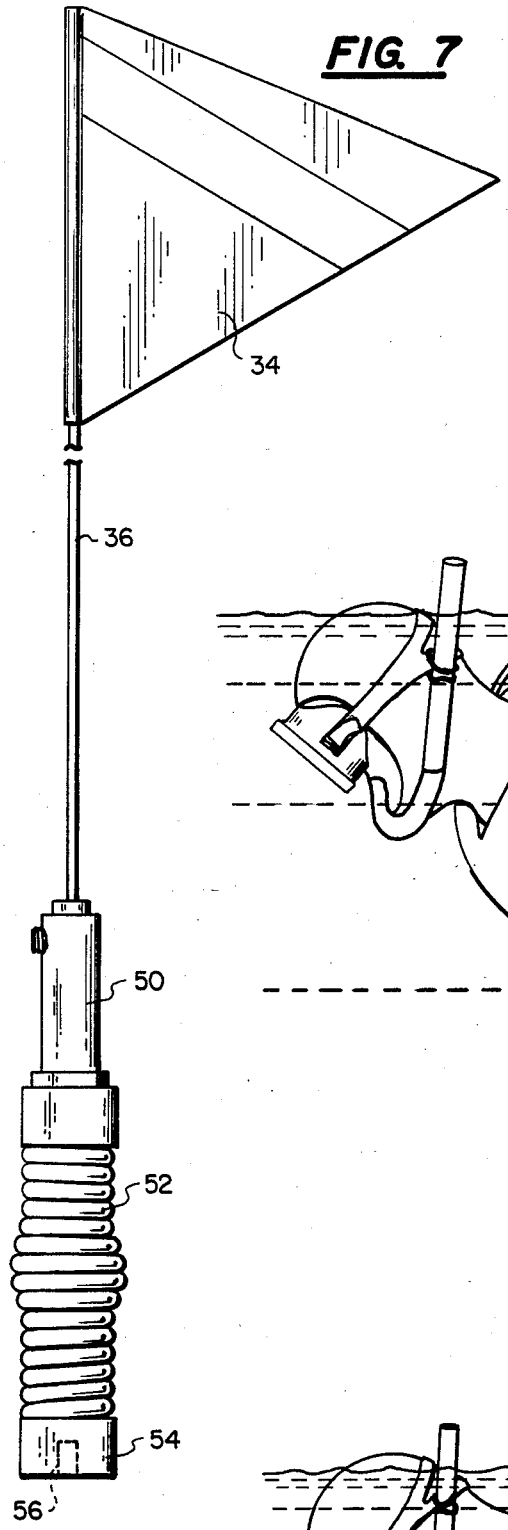
FIG. 7 is a side elevation view of an alternative flag assembly with a resilient mounting.

When the flag is mounted so that the mast is behind the diver's shoulder, as in FIG. 2, it does not interfere with the diver's movements and does not require any attention to ensure its proper deployment.

In an alternative configuration illustrated in FIGS. 7–12, the mast 36 with its flag 34 is secured in a socket member 50 which is attached to the upper end of a coil spring 52. At the lower end of the coil spring is a base member 54 with a threaded socket 56 in the underside.

Figure 11:
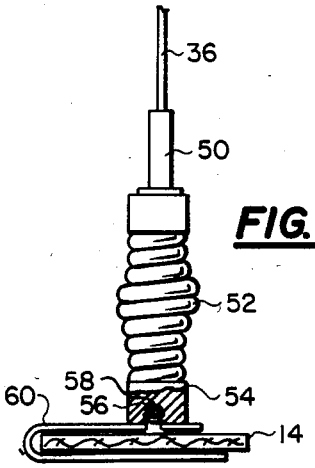
FIG. 11 is an enlarged view, partially cut away, of the resilient mounting in FIG. 8.

This mounting can be attached to the diver in various ways to suit the equipment being worn. In FIG. 11 the base member 54 is secured on a threaded stud 58 mounted on a flat C-clip 60, which can be slipped over the weight belt 14 at the diver's back, to project above the water when the diver is face down, as in FIG. 9.

Figure 8:
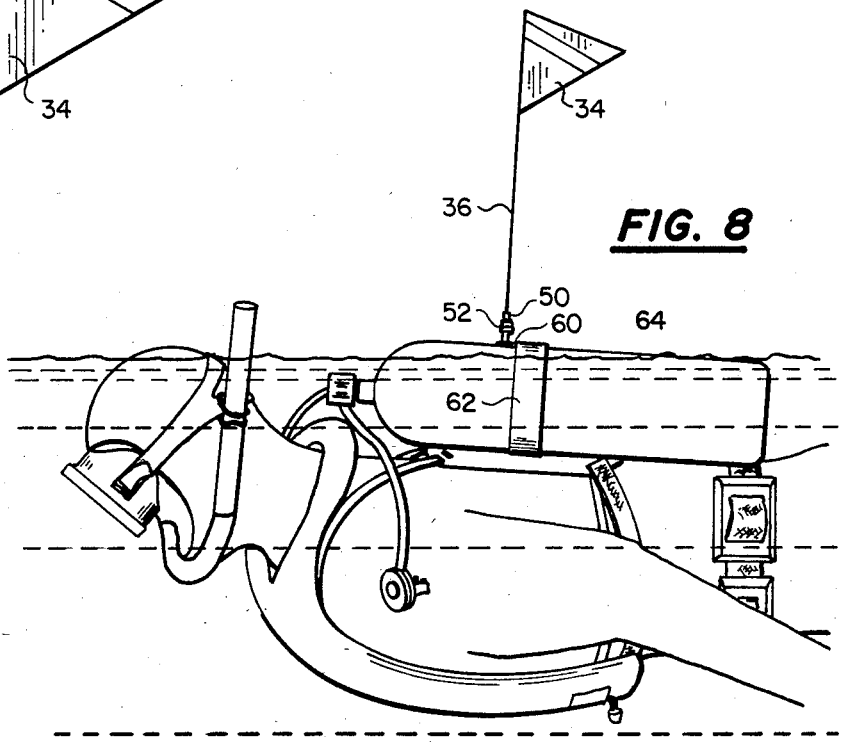
FIG. 8 illustrates the resiliently mounted flag on a diver's air tank.
Figure 9:
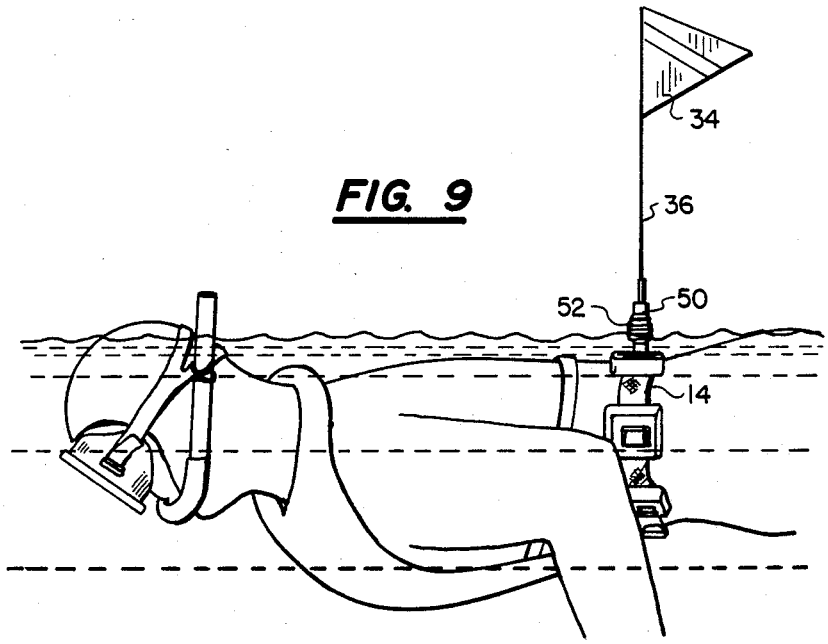
FIG. 9 illustrates the resiliently mounted flag on a diver's weight belt.
Figure 10:
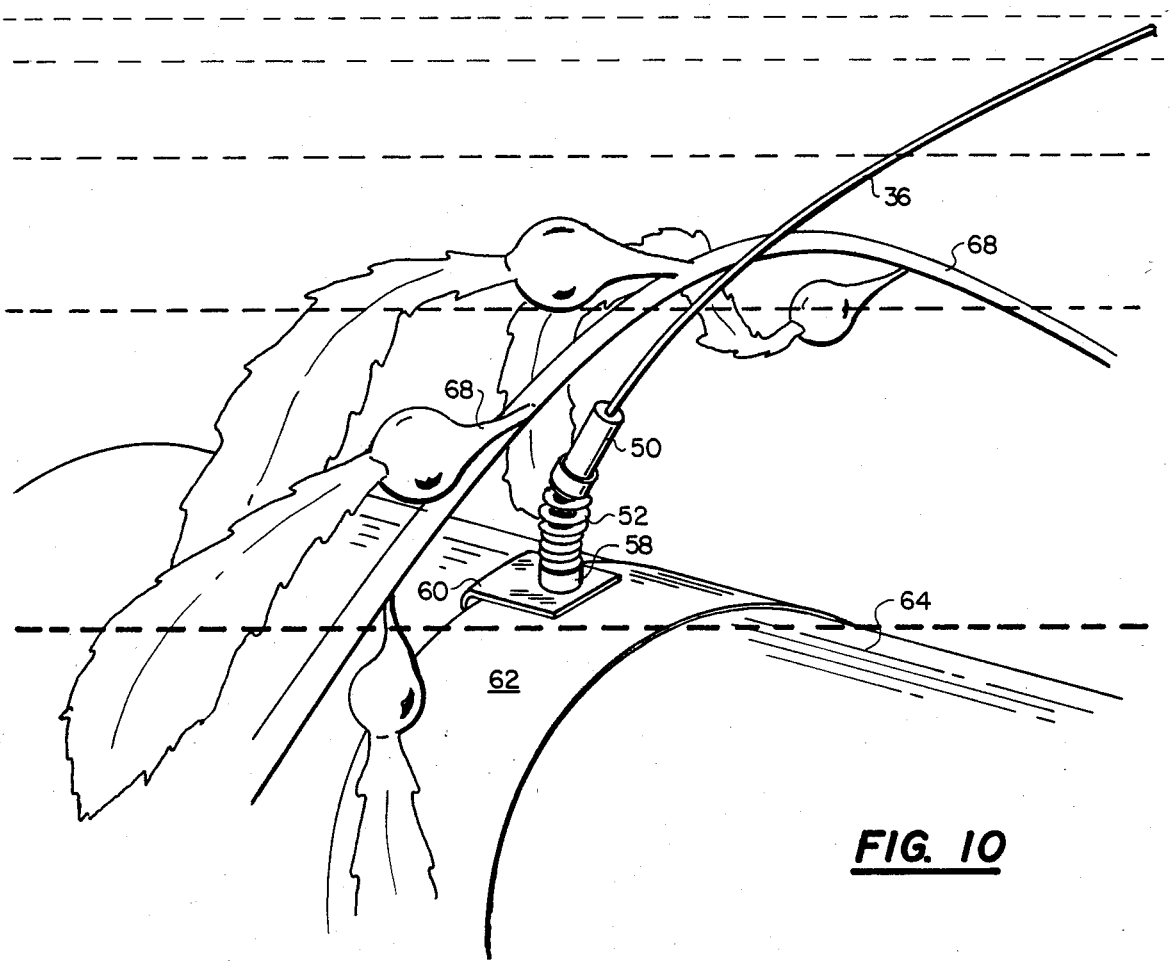
FIG. 10 shows the deflection of the flag by kelp.

Alternatively the clip 60 can be secured on the strap 62 holding the air tank 64, as in FIGS. 8 and 10.

Figure 12:
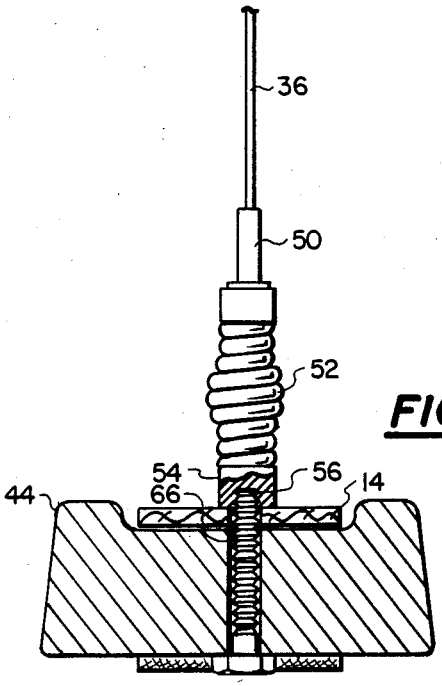
FIG. 12 is an enlarged view, partially cut away, of the resilient mounting in FIG. 9.

In a further mounting, shown in FIG. 12, the base member 54 is secured by a bolt 66 extending through one of the weights 44 and belt 14 and threaded into socket 56.

In the spring mounted configurations the flag projects above the surface when the diver is substantially horizontal, but also provides added visibility when the diver is submerged. FIG. 10 illustrates how the spring 52 allows pivotal freedom for the mast 36 to be deflected by kelp 68, or any other obstructions, so preventing the diver from becoming entangled.

The flag can thus be mounted in various ways to suit the particular activities of the diver.

It shold be understood that the structure shown in exemplary and that mechanical details and proportions may vary without departing from the scope of the invention.

Having described my invention,

I claim:

1. A diver's safety flag having means for maintaining a vertical orientation of the flag during driving activity, comprising:

mounting means for attachment of said safety flag to a portion of a diver's equipment eccentric mass means pivotally mounted on said mounting means for freely pivoting about a normally horizontal axis; and an elongated mast secured to said mounting means and biased by said eccentric mass to a normally vertical position, whereby said mast remains vertical and projects above the water regardless of the attitude of a diver at or near the surface of the water.

2. A safety flag according to claim 1 wherein said mounting means includes loop means for receiving and encircling a diver's weight belt.

3. A safety flag according to claim 1 wherein said mounting means includes a horizontal shaft, and said eccentric mass is rotatably mounted on said shaft.

4. A safety flag according to claim 1 wherein said eccentric mass includes a vertically oriented socket and said mast is mounted in said socket.

5. A safety flag according to claim 1 wherein said eccentric mass has a generally pendulum configuration with an apex about which said mass is mounted to rotate.

6. A safety flag according to claim 2 wherein said mounting means includes a horizontal shaft, and said eccentric mass is rotatably mounted on said shaft.

7. A safety flag according to claim 6 wherein said eccentric mass includes a vertically oriented socket and said mast is mounted in said socket.

8. A safety flag according to claim 7 wherein said eccentric mass has a generally pendulum configuration with an apex about which said mass is mounted to rotate.

9. A diver's safety flag having means for maintaining a vertical orientation of the flag during diving activity, comprising:

mounting means including loop means for receiving and encircling a belt for attachment to and positionable at the side of a diver, said mounting means including a normally horizontally extending shaft;

eccentric mass means having a generally pendulum configuration pivotally mounted on said shaft for freely pivoting about a normally horizontal axis, and including a normally vertically oriented socket formed in said mass means; and an elongated mast detachably mounted in said socket in said eccentric mass means and biased by said eccentric mass means to a normally vertical position, whereby said mast remains vertical and projects above the water regardless of the attitude of a diver at or near the surface of the water.

10. A safety flag according to claim 9 wherein said eccentric mass has a generally pie segment shaped pendulum configuration with an apex about which said mass is mounted to rotate and a thickened arcuate portion defining the mass.

* * * * *